United States Patent [19]

Hanson et al.

[11] 3,936,959

[45] Feb. 10, 1976

[54] SKI BOOT WITH REPLACEABLE LINER

[75] Inventors: Alden B. Hanson; Chris A. Hanson, both of Boulder, Colo.

[73] Assignee: Hanson Industries Inc., Boulder, Colo.

[22] Filed: Feb. 12, 1975

[21] Appl. No.: 549,203

[52] U.S. Cl. ..... 36/2.5 AL
[51] Int. Cl.[2] ..... A43B 00/00
[58] Field of Search ..... 36/2.5 R, 2.5 AL, 50

[56] References Cited

UNITED STATES PATENTS

| | | | |
|---|---|---|---|
| 3,640,003 | 2/1972 | Anderson | 36/2.5 AL |
| 3,790,991 | 2/1974 | Hanson et al. | 36/2.5 AL |
| 3,803,730 | 4/1974 | Hanson et al. | 36/2.5 AL |

*Primary Examiner*—Patrick D. Lawson
*Attorney, Agent, or Firm*—Merriam, Marshall, Shapiro & Klose

[57] ABSTRACT

A rear-entry ski boot comprising a semi-rigid shell is provided with a two-piece liner system, one section of which covers the forward portion of the user's foot from behind the ankle bones, the second section covering the heel and Achilles' tendon areas, the sections cooperating to cover the entire surface of the wearer's foot within the shell. The liner sections are not interconnected, and at least the second section is readily removable and replaceable. By selection of an appropriate rear section, a custom fit can be more easily achieved, and changes in the wearer's foot size, as in the case of children, can be readily accomodated.

7 Claims, 7 Drawing Figures

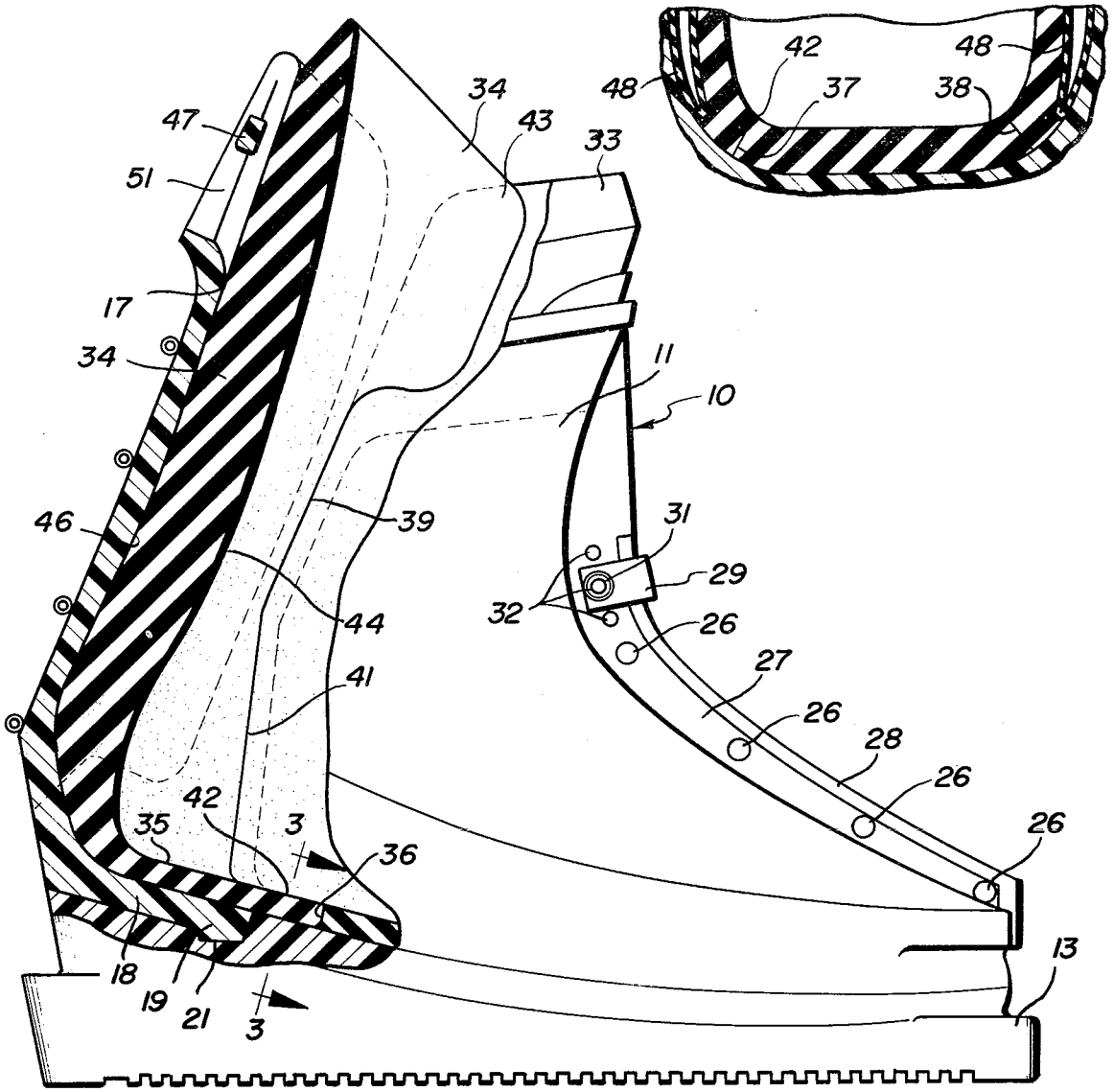
FIG. 3
48
38
37
42
48
FIG. 1
33
43
34
10
11
31
29
26
27
26
28
26
26
13
32
39
44
41
36
3
3
42
21
19
18
35
47
51
17
34
46
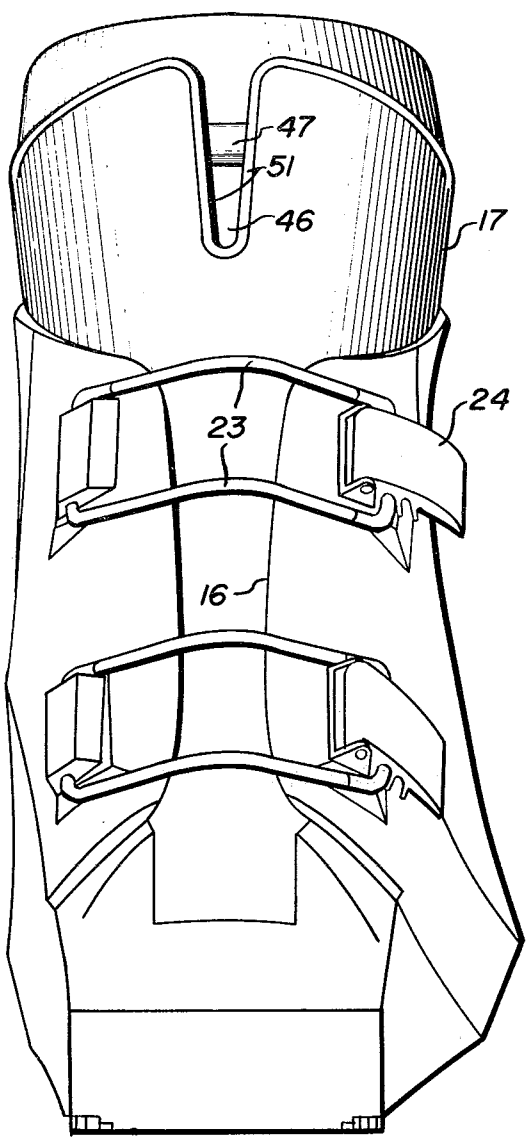
FIG. 2
17
24
47
51
46
23
16

SKI BOOT WITH REPLACEABLE LINER

This invention relates to ski boots and more particularly to a rear-entry ski boot having a semi-rigid outer shell and an inner resilient liner. Still more particularly, the invention relates to a boot having a liner comprising two separate sections, a forward portion covering the forward portion of the wearer's foot from behind the ankle bones and a rearward portion covering the heel and Achille's tendon area thereof. At least the rearward section of liner is readily removable from the shell, so that by appropriate selection of the thickness and contour of this section, an accurate custom fit can be made between the feet of the wearer and the shell of the boot, thereby increasing the comfort and control which the boots afford.

BACKGROUND

Most currently available ski boots, including those enjoying the widest popularity among skiers, comprise a semi-rigid outer shell formed of a synthetic plastic material, enclosing a resilient liner designed to adapt the contours of the wearer's foot firmly to that of the shell, while permitting the wearer a reasonable degree of comfort. Because of practical considerations, the outer shells are made in a limited number of different sizes, each size of shell being intended to cover several different foot sizes. In order to custom fit the feet of a wearer to a shell of appropriate size, there are employed liner assemblies of different types, all of which are intended to secure firm engagement of the wearer's foot to the shell of the boot while at the same time avoiding pressure points which might cause discomfort. A wide variety of liners has been used, including assemblies comprising bags containing a flowable, putty-like material, or resilient plastic, fibrous or other non-flowable material, all of which are usually installed at the factory and thus lack the capability for a true custom fit to the wearer's foot. Other liner systems include the use of an injected foamable material installed in a dealer's shop and intended to fill the void between the wearer's foot and the outer shell. Such systems have several disadvantages, including the necessity for very close control of the amount of foamable material injected, and practical difficulties arising from the heat, odor, and clean-up problems encountered during the foaming procedures.

Another liner system, as described in our U.S. Pat. No. 3,798,799, issued Mar. 26, 1974, uses a liner assembly including a resilient inner padding member having an outer surface which defines one or more cavities between the padding member and the inner surface of the shell. Into these cavities, there is injected a non-compressible thermo-plastic fitting material which is flowable during injection but thereafter hardens sufficiently to give firm support to the foot while affording comfort for skiing.

In one embodiment of the system disclosed in U.S. Pat. No. 3,798,799, intended for use with a rear opening boot, the liner assembly does not itself cover the entire surface of the wearer's foot and ankle enclosed within the shell, the liner being open at the back for removal of the wearer's foot through the rear opening of the boot. The rear opening, which is closed by means of a vertical tongue member pivotally connected at its bottom to the shell, is provided with a pad, which, when the tongue is in the closed position, abuts the rear portion of the wearer's ankle and serves a padding function for this portion of the wearer's foot. The liner attached to the tongue member is an integral portion thereof, being installed at the factory, and is, therefore, designed to accommodate a foot of average or typical contour. The custom fitting aspect of the liner assembly is provided by a bladder which covers the wearer's instep area and the sides of his ankle, into which bladder there is injected a thermo-plastic material under sufficient pressure to fill the space between the wearer's foot and the inside surface of the shell. Although the custom fit produced by the described liner system is generally satisfactory, there is occasionally encountered some difficulty in producing the desired close fit in the rear portion of the ankle above the heel and in the vicinity of the Achille's tendon area, particularly in the case of skiers having ankle or calf contours which vary markedly from the average.

SUMMARY

In accordance with the invention, there is provided a liner assembly for use in a rear entry boot having a semi-rigid shell, which liner assembly comprises two individual portions which together completely enclose the wearer's foot. The forward section of the liner, which is in contact with the forward section of the wearer's foot, excluding the heel and Achille's tendon areas, is similar in construction to that shown in U.S. Pat. No. 3,798,799. The rearward section of the liner, however, is not integrally connected to the vertical tongue member described in the aforementioned patent, but is rather an independent section which encloses the heel and Achille's tendon areas of the foot of the wearer. By suitable selection of the rearward section of a liner, a custom fit can be readily made to accommodate variations in the ankle and calf sizes of skiers having the same nominal foot size. In addition, provision can be made for making the forward section of liner also removable, whereby by replacement of both sections of the liner, a given shell can be used to accommodate a skier whose foot size has changed, as in the case of a growing child. Since the cost of the shell represents a major portion of the entire cost of the boot, the re-use of the shell to accommodate a skier having a different foot size or contour than those to which the boot was originally fitted, represents a substantial economy. In addition, the invention permits dealers to custom fit a larger variety of foot sizes and shapes with a minimum inventory of shells.

The invention will be better understood from the detailed description thereof, taken in conjunction with the accompanying drawings, in which:

FIG. 1 represents a side elevation of a boot in accordance with the invention, the rear portion of the boot being in section to illustrate the liner assembly of the invention;

FIG. 2 is a view of the rear end of the boot of FIG. 1, illustrating a modification in the vertical tongue forming the rear closure which permits an adjustment in flexibility by the skier;

FIG. 3 is a section along the line 3—3 of FIG. 1, showing the placement of the liner within the shell of the boot;

Figure 4:
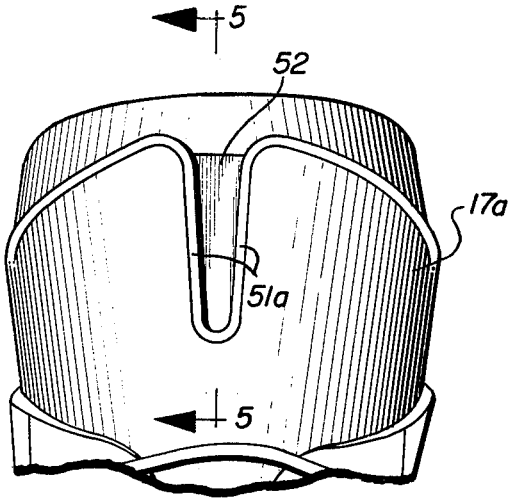
FIG. 4 shows an alternative embodiment of means for providing adjustable flexibility in the rear tongue of the boot shown in FIG. 2.

Referring to the figures, there is depicted a boot 10, including a semi-rigid shell 11 having a vamp 12 attached to a sole 13. The boot is provided with a rear entry defined in part by rear edges 14 and 16 of vamp 12. Situated in and closing the rear opening of the vamp is a vertical tongue member 17 which is pivotally connected to the shell at a point near the lowermost edge of the rear opening, by means of an extended arm portion 18 provided with a lug 19 at its free end, which lug nests within a suitably dimensioned groove 21 in the top surface of 13, which forms the floor of vamp 12.

With tongue member 17 in its closed position, as shown in FIG. 2, the rear opening of the boot is closed by means of securing means which includes a clamp 22, an endless cable 23 and a buckle 24. While at least one such securing means is essential, it is preferred to use two as illustrated, although more than two can also be used.

In a preferred embodiment as shown in FIg. 1, the shell 11 of the boot is preferably molded in two complementary shell portions which are mated together in a vertical plane along a center line extending from the toe to the heel of the boot, as described in our U.S. Pat. No. 3,848,347, issued Nov. 19, 1974. In accordance with such constrtuction, the complementary halves of shell 11 are joined at the forward portion of the vamp 12 by means of rivets 26 passing through mating ribs, e.g., 27, extending outwardly from the rounded front surface of the vamp. Each of ribs 27 has an outwardly flaring flange 28 which is substantially perpendicular to the rib. The forward edges of the mating sections of shell 11 are not permanently joined at any point above uppermost rivet 26 but are left free to separate on forward pressure of the skier's foot at the top of shell 11, thus permitting the shell to flex. In order to permit a degree of adjustability in the flex caused by such forward pressure, slide clip 29, which rides on flanges 28, can be adjustably positioned with its locating pin 31 passing through a desired one of holes 32 through ribs 27. By positioning clip 29 in the uppermost hole 32, the length of the split in the upper section of the vamp is shortened, thereby increasing the stiffness of the vamp. By positioning the slide clip at a lower point, a greater degree of flex, ile., less stiffness, is provided, as described in the aforementioned U.S. Pat. No. 3,848,347. In order to reduce the degree of stiffness in the upper section of the vamp, it may be desirable to eliminate the flange portion 28 of rib 27 above the uppermost positioning hole 32, as shown in FIg. 1.

Fitted within shell 11 of the boot is a liner assembly consisting of two separate parts, a forward section 33 and a rear section 34. The forward section 33 has an inner surface which follows the contours of that portion of the wearer's ankle and foot forward of a vertical line passing approximately through the wearer's tibia, not including any of the heel portion of the wearer's foot. The rear section 34 of the liner has an inner contour which when mated with forward section 33 completely covers the wearer's foot, including the ankle portion thereof. Rear section 34 completely covers the wearer's heel and is provided with a tongue-like flap 35 which extends forward under the heel to a point where it joins the mating edge of forward section 33 at a vertical partition surface 36. The sides of the flap 35 abut the edges of forward section 33 in generally vertical partition surfaces 37 and 38 (Fig. 3). At the points of contact between the adjacent portions of the liner, the opposed surfaces meet in abutting relationship, indicated by the lines 39, 41, and 42, as shown in FIGS. 1 and 3. At the top of the boot, however, rear section 34 is provided with flaps 43 which overlap the adjacent portions of forward section 33, and thus create a more secure seal against the entry of snow.

It will be seen in FIG. 1, that in the vicinity of the wearer's Achille's tendon, rear liner section 34 has a substantial thickness between its outer surface 44 and the inner surface 46 of vertical tongue 17, against which it abuts. In the event that a given rear liner section provides insufficient room for a particular foot configuration, and thus lead to excessive pressure, the entire rear section 44 can be removed and replaced with one having a thinner rear wall, thus accommodating the wearer's foot and providing a custom fit. The ready replaceability of the liner sections, and particularly the rear liner section, is particularly advantageous in boots for use by children. In such cases, a new boot may be supplied with a relatively thick rear liner. As the size of the child's foot grows, the rear section can be removed and replaced with one having a thinner wall, thus permitting several seasons of use from the same shell. If desired or necessary, the forward section of the liner can be replaced in the same way. Initially, a forward section having a relatively thick wall section can be used, and replaced successively with liners having thinner walls in order to accommodate the growing foot of the user.

In accordance with the invention, there is no integral attachment between rear liner section 34 and the inner surface of tongue 17. When tongue 17 is rotated rearwardly between rear edges 14, 16 of vamp 12 in order to permit entry to the interior of the boot, rear liner section 34 flexes at its connecting flap 35 lying on the floor of vamp 12, connecting flap 35 being held in place by frictional contact with the edges of forward section 33, as shown in FIG. 3. During normal use of the boot, therefore, the rear section 34 will remain in position during opening and closing of the boot. If it is desired to replace the section, however, it can be readily pulled out of position and a replacement section readily installed.

In another aspect of the invention, provision is made for varying the rearward flexibility of tongue member 17 in accordance with the desire of the skier. As shoown in FIG. 2, the upper portion of tongue member 17 is provided with a downwardly extending V-shaped split 46, the edges of which are defined by relatively thick ribs 51. The opposing edges of split 46 are unconnected except at a point near the top of the split, at which point there is an inter-connecting member 47, advisably integrally formed in tongue 17, spanning the split and joining the opposed edges. In the form shown in FIG. 2, the edges of split 46 cannot separate in response to rearward pressure at the top of the tongue, thus providing a certain degree of rigidity. If the skier desires the top of tongue 17 to be more flexible, he need only cut interconnecting member 47, thus permitting the edges of the V-sahped split to separate in response to rearward pressure, resulting in greater flexibility.

Figure 5:
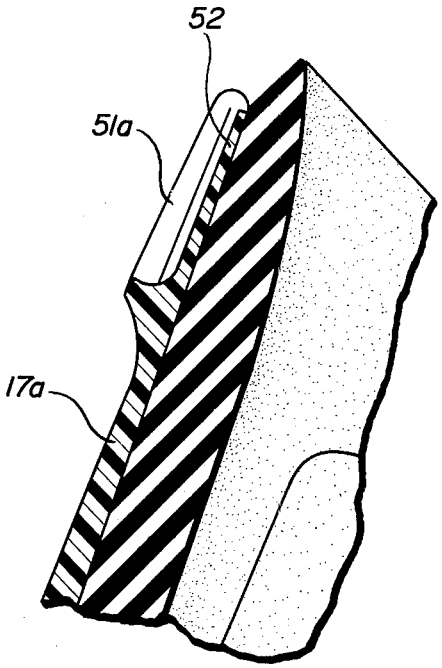
FIG. 5 is a sectional view along the line 5—5 of FIG. 4.

In an alternative embodiment shown in FIGS. 4 and 5, no split portion or void area is provided in tongue member 17*a* between ribs 51*a*, the opposite edges of which are interconnected throughout their length by member 52, which is suitably an integral extension of the wall of member 17*a*. With ribs 51*a* interconnected by member 52 as shown in FIG. 4, i.e., without the split provided in the embodiment of Fig. 2, tongue member 17*a* has its greatest degree of rigidity. To increase the flexibility of tongue member 17*a*, some or all of member 52 between ridges 51*a* can be cut or otherwise removed, thus creating in effect a split similar to that of the embodiment of Fig. 2. A further increase in the flexibility of tongue member 17*a* can be obtained by reducing the thickness or width of ribs 51 by shaving or filing, thus permitting the edges of the split to separate more easily on the application of a rearward force.

Figure 6:
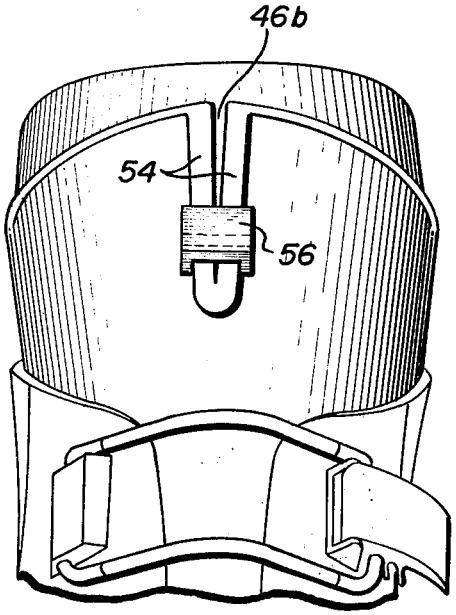
FIG. 6 is a view of still another embodiment of means for providing adjustable flexibility in the tongue of the boot shown in FIG. 2.
Figure 7:
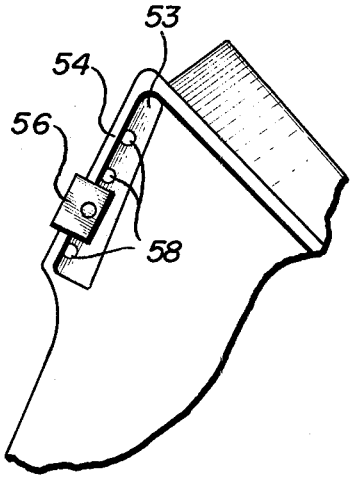
FIG. 7 is a partial right side view of the embodiment of FIG. 6.

In the embodiments shown in Figs. 2, 4, and 5, the change in flexibility obtained by cutting member 47 or member 52 is permanent. It is also within the contemplation of the invention, however, to provide means for adjustably increasing or decreasing the rigidity of tongue 17, by providing an adjustable clamp interconnecting the edges of a split in tongue 17, as disclosed and claimed in our U.S. Pat. No. 3,848,347. An embodiment of such a construction is shown in Figs. 6 and 7. As shown, tongue 17*b* is provided with a split 46*b*, the edges of which are provided with outwardly extending ribs 53. The ribs 53 have outwardly flaring flanges 54 on which a slidable clip 56 rides. Clip 56 has a locating pin 57 which can be passed through any one of holes 58 through ribs 53, thereby controlling the extent of separation of split 46*b* in response to rearward pressure and hence the flexibility of tongue 17*b*.

The ski boot of the invention is readily adapted for and preferably used with the fitting method and means described in our aforementioned U.S. Pat. No. 3,798,799, in which there is employed a bladder or the like positioned between the forward liner and the shell of the boot, into which there is injected aa thermoplastic flowable material which provides the custom fit. In Fig. 3, there is shown a portion of the bladder 48 provided between the inner liner and the shell 11 of the boot, into which the thermoplastic material can be injected.

The foregoing detailed description has been give for clearness of understanding only, and no unnecessary limitations should be understood therefrom as modiciations will be obvious to those skilled in the art.

We claim:

1. A ski boot comprising:

a semi-rigid shell comprising a vamp having a rear opening;

a semi-rigid tongue member pivotally attached to said vamp near the lowermost portion of said rear opening, said tongue member being adapted to close said rear opening;

securing means for securing said tongue member in the closed position;

a first resilient liner member disposed in the forward section of said shell, said first liner member having an inner surface conforming substantially to the outer surface of a wearer's foot forward of the heel and Achille's tendon area thereof and an outer surface contoured to fit into the forward section of said shell;

a second resilient liner member disposed within the rearward portion of said shell, said second liner having an inner surface conforming to the outer surface of the heel and Achille's tendon area of the wearer's foot, and an outer surface contoured to fit the rearward section of said shell and abut the inner surface of said tongue member;

the edges of said first and second liner members abutting each other within said shell and cooperating to cover the entirety of the wearer's foot, at least said second liner member being readily removable from said shell.

2. A ski boot in accordance with claim 1 wherein said first liner member is readily removable from said shell.

3. A ski boot in accordance with claim 1 in which said tongue member is provided with means for adjusting the flexibility of said tongue member in response to rearward pressure.

4. A ski boot in accordance with claim 3 in which said tongue member is provided with a pair of thickened stiffening ribs formed on the surface of said tongue member and arranged in the form of a V, the opposed inner edges of said V being interconnected by a portion of said tongue member, said portion being severable to increase the flexibility of said tongue in response to rearward pressure applied thereto.

5. A ski boot in accordance with claim 3, wherein said tongue member is provided with a vertical split extending downwardly from the top thereof, the opposing edges of said split along a portion of its length being interconnected by a transverse connecting member, said connecting member being severable to permit the edges of said split to separate on the application of rearward pressure to the top of said tongue, whereby the flexibility of said tongue member can be increased at the option of the wearer of the boot by severing said connecting member.

6. A ski boot in accordance with claim 5, in which said split and said connecting member are integrally formed in said tongue member.

7. A ski boot in accordance with claim 1, in which said second liner member includes a flap portion extending under the heel of the wearer of said boot, said flap portion acting as a hinge for permitting said second liner member to be pivoted through said rear opening for permitting entry of the wearer's foot into said boot.

* * * * *